US009187273B2

(12) United States Patent
Kodama

(10) Patent No.: US 9,187,273 B2
(45) Date of Patent: Nov. 17, 2015

(54) CORRUGATED PAPERBOARD SHEET FEEDING APPARATUS

(71) Applicant: KABUSHIKI KAISHA ISOWA, Nagoya-shi, Aichi (JP)

(72) Inventor: Junichi Kodama, Kasugai (JP)

(73) Assignee: KABUSHIKI KAISHA ISOWA, Nagoya-Shi (JP)

( * ) Notice: Subject to any disclaimer, the term of this patent is extended or adjusted under 35 U.S.C. 154(b) by 0 days.

(21) Appl. No.: 14/575,254

(22) Filed: Dec. 18, 2014

(65) Prior Publication Data

US 2015/0183594 A1 Jul. 2, 2015

(30) Foreign Application Priority Data

Dec. 26, 2013 (JP) ..... 2013-268912

(51) Int. Cl.

| | |
|---|---|
| ***B65H 1/06*** | (2006.01) |
| ***B65H 11/00*** | (2006.01) |
| ***B65H 9/04*** | (2006.01) |
| ***B65H 3/34*** | (2006.01) |

(52) U.S. Cl.

CPC .. *B65H 1/06* (2013.01); *B65H 3/34* (2013.01); *B65H 9/04* (2013.01); *B65H 11/00* (2013.01)

(58) Field of Classification Search

CPC ..... B65H 1/06; B65H 1/30; B65H 3/34; B65H 3/60; B65H 2701/176; B65H 2701/1762

USPC ..... 271/145, 167, 169, 143, 144

See application file for complete search history.

(56) References Cited

U.S. PATENT DOCUMENTS

| | | | | |
|---|---|---|---|---|
| 1,739,153 | A * | 12/1929 | Laxo et al. | 271/31 |
| 5,057,066 | A * | 10/1991 | Nagahashi et al. | 493/317 |
| 5,941,681 | A * | 8/1999 | Piotrowski et al. | 414/797.8 |
| 2001/0007847 | A1 * | 7/2001 | Greenwell | 493/81 |
| 2001/0042953 | A1 * | 11/2001 | Honda | 271/10.11 |
| 2002/0158402 | A1 * | 10/2002 | DaCunha et al. | 271/35 |
| 2013/0292895 | A1 * | 11/2013 | Ito | 271/35 |

FOREIGN PATENT DOCUMENTS

| | | | | |
|---|---|---|---|---|
| DE | 3237943 | A1 * | 4/1984 | B65G 57/16 |
| JP | 2000-44065 | A | 2/2000 | |
| JP | 4193187 | B1 | 12/2008 | |

* cited by examiner

*Primary Examiner* — Patrick Cicchino
(74) *Attorney, Agent, or Firm* — Brinks Gilson & Lione

(57) ABSTRACT

The corrugated paperboard sheet feeding apparatus comprises: a sheet feeding table; a front guide for regulating a front end of a corrugated paperboard sheet; a back guide for regulating a rear end of the corrugated paperboard sheet; and a guide element for separating the corrugated paperboard sheets so as to form a plurality of separate groups, wherein the guide element includes: a first guide element formed in the front guide to have a first separation guide surface; and a second guide element formed in the back guide to have a cutout portion, and a second separation guide surface, and wherein the cutout portion of the second guide element is formed in such a manner that an amount of concavity thereof is greater than an amount of protrusion of the lower edge of the first separation guide surface of the first guide element.

4 Claims, 7 Drawing Sheets

CORRUGATED PAPERBOARD SHEET FEEDING APPARATUS

RELATED APPLICATIONS

This application claims priority under 35 U.S.C. §119 to Japanese Patent Application No. 2013-268912 filed on Dec. 26, 2013, the entire content of which is hereby incorporated by reference.

TECHNICAL FIELD

The present invention relates to a corrugated paperboard sheet feeding apparatus for sequentially feeding a plurality of stacked corrugated paperboard sheets toward a downstream side.

BACKGROUND ART

For example, in the following Patent Document 1, there is disclosed a corrugated paperboard sheet feeding apparatus capable of holding an end, e.g., front and rear ends, of each of a plurality of corrugated paperboard sheets stacked in a hopper, in such a manner as to separate top-side ones of the corrugated paperboard sheets from bottom-side ones of the corrugated paperboard sheets to form a plurality of separate groups in an up-down direction, thereby reducing a load to be imposed on a bottommost one of the corrugated paperboard sheets, and cause the corrugated paperboard sheets to sequentially move toward the side of a bottom end of the hopper.

As illustrated in FIG. 7, the corrugated paperboard sheet feeding apparatus 100 disclosed in the Patent Document 1 comprises a front guide 101, a back guide 107, and two holding rollers 103, 104 disposed offset in an up-down direction, wherein the holding rollers 103, 104 are configured to come into contact, respectively, with a front end and a rear end of each of a plurality of corrugated paperboard sheets 102 stacked between the front guide 101 and the back guide 107, to separate top-side ones of the corrugated paperboard sheets 102 from bottom-side ones of the corrugated paperboard sheets 102 so as to form three separate groups in the up-down direction. The two holding rollers 103, 104 are pivotally and rotatably supported, respectively, by the front guide 101 and the back guide 107 disposed opposed to each other. Each of the holding rollers 103, 104 has an outer peripheral surface formed with ratchet teeth to increase a friction coefficient with respect to each corrugated paperboard sheet 102. The corrugated paperboard sheet feeding apparatus 100 further comprises a drive device configured to, when a decrease in stacking height of each of two groups of corrugated paperboard sheets 102 located below the respective holding rollers 103, 104 is detected by a respective one of two phototubes 105, 106, rotationally drive the holding rollers 103, 104 to cause downward displacement of the corrugated paperboard sheets 102.

CITATION LIST

Patent Document 1: JP 2000-044065 A

SUMMARY OF THE INVENTION

However, the above corrugated paperboard sheet feeding apparatus 100 has the following problems.

In order to separate the top-side corrugated paperboard sheets 102 from the bottom-side corrugated paperboard sheets 102 so as to form three separate groups in the up-down direction, the outer peripheral surface of each of the holding rollers 103, 104 is disposed to protrude toward the side of the corrugated paperboard sheets, with respect to a guide surface of a respective one of the front guide 101 and the back guide 107. Thus, when the holding rollers 103, 104 are rotationally driven to cause downward displacement of the top-side corrugated paperboard sheets 102, each of the top-side corrugated paperboard sheets 102 will move downwardly while climbing over the outer peripheral surfaces of the holding rollers 103, 104.

However, when each of the corrugated paperboard sheets 102 climbs over the outer peripheral surface of each of the holding rollers 103, 104, the corrugated paperboard sheet 102 is pressed between the outer peripheral surface of the holding roller 103 (104) and the guide surface of the back guide 107 (front guide 101) opposed to the outer peripheral surface, in a front-rear direction.

As a result, a front or rear end of the pressed corrugated paperboard sheet is deformed, or the pressed corrugated paperboard sheet is warped. This leads to a problem of occurrence of a defective corrugated paperboard sheet and a problem of deterioration in sheet feeding accuracy.

Moreover, the corrugated paperboard sheet feeding apparatus 100 is equipped with the drive device configured to, when a decrease in stacking height of each of two groups of corrugated paperboard sheets 102 located below the respective holding rollers 103, 104 is detected by a respective one of the phototubes 105, 106, rotationally drive the holding rollers 103, 104 to cause downward displacement of the corrugated paperboard sheets 102. Thus, it is necessary to ensure an installation space for the drive device, and provide a control device for controlling a drive timing and a rotation speed of each of the holding rollers 103, 104.

Further, depending on a sheet type and a flute type of corrugated paperboard sheet, and a feeding speed of corrugated paperboard sheets, it is necessary to perform an operation of strictly adjusting the drive timing and the rotation speed of each of the holding rollers 103, 104. Furthermore, the outer peripheral surface of each of the holding rollers 103, 104 is formed with ratchet teeth to increase a friction coefficient with respect to each corrugated paperboard sheet 102. Thus, due to biting of a front or rear end of the corrugated paperboard sheet 102 into the ratchet teeth of the holding roller 103 or 104, the corrugated paperboard sheet 102 is likely to fail to adequately drop downwardly, resulting in jamming inside the apparatus.

This leads to a problem of an increase in maintenance cost of the corrugated paperboard sheet feeding apparatus and a deterioration in operation rate of the corrugated paperboard sheet feeding apparatus.

The present invention has been made to solve the above problems, and an object thereof is to provide a corrugated paperboard sheet feeding apparatus capable of improving corrugated paperboard sheet feeding accuracy and suppressing an increase in maintenance cost and a deterioration in operation rate thereof.

SUMMARY OF THE INVENTION

In order to achieve the above object, a corrugated paperboard sheet feeding apparatus of the present invention has the following features.

(1) The present invention provides a corrugated paperboard sheet feeding apparatus for sequentially feeding a plurality of stacked corrugated paperboard sheets toward a downstream side. The corrugated paperboard sheet feeding apparatus comprises: a sheet feeding table; a front guide provided to stand on the sheet feeding table, wherein the front guide has a guide surface for regulating a front end of a corrugated paperboard sheet; a back guide provided to stand on the sheet feeding table, wherein the back guide has a guide surface for regulating a rear end of the corrugated paperboard sheet; and a guide element configured to come into contact with a front or rear end of each of a plurality of corrugated paperboard sheets stacked between the front guide and the back guide to separate top-side ones of the corrugated paperboard sheets from bottom-side ones of the corrugated paperboard sheets so as to form a plurality of separate groups, wherein the guide element includes: a first guide element formed in the front guide to have a first separation guide surface protruding obliquely downwardly and rearwardly with respect to the guide surface of the front guide; and a second guide element formed in the back guide to have a cutout portion located below a lower edge of the first separation guide surface of the front guide and concaved rearwardly from the guide surface of the back guide, and a second separation guide surface extending obliquely downwardly and forwardly from a lower edge of the cutout portion and protruding forwardly with respect to the guide surface of the back guide, and wherein the cutout portion of the second guide element is formed in such a manner that an amount of concavity thereof with respect to the guide surface of the back guide is greater than an amount of protrusion of the lower edge of the first separation guide surface of the first guide element with respect to the guide surface of the front guide.

In the present invention, the first guide element is formed in the front guide to have a first separation guide surface protruding obliquely downwardly and rearwardly with respect to the guide surface of the front guide. Thus, when a front end of one of a top group of corrugated paperboard sheets stacked between the front guide and the back guide comes into contact with the first separation guide surface, the corrugated paperboard sheet being in contact with the first separation guide surface moves obliquely downwardly and rearwardly along the first separation guide surface.

Further, the second guide element is formed in the back guide to have a cutout portion located below a lower edge of the first separation guide surface and concaved rearwardly from the guide surface of the back guide. Thus, a rear end of a lowermost corrugated paperboard sheet of the top group moving obliquely downwardly and rearwardly along the first separation guide surface is inserted into the cutout portion of the second guide element. Then, the amount of concavity of the cutout portion with respect to the guide surface of the back guide is greater than the amount of protrusion of the lower edge of the first separation guide surface with respect to the guide surface of the front guide. Thus, when the rear end of the lowermost corrugated paperboard sheet of the top group is inserted into the cutout portion of the second guide element, a front end of the lowermost corrugated paperboard sheet of the top group slips out of the lower edge of the first separation guide surface and drops downwardly to become one of an intermediate group of corrugated paperboard sheets.

The second guide element is also formed to have a second separation guide surface extending obliquely downwardly and forwardly from a lower edge of the cutout portion and protruding forwardly with respect to the guide surface of the back guide. Thus, a rear end of each corrugated paperboard sheet of the intermediate group inserted into the cutout portion moves obliquely downwardly and forwardly along the second separation guide surface. When a rear end of a lowermost corrugated paperboard sheet of the intermediate group moves obliquely along the second separation guide surface to reach the lower edge of the second separation guide surface, the rear end of the lowermost corrugated paperboard sheet of the intermediate group slips out of the lower edge of the second separation guide surface and drops downwardly.

The dropped corrugated paperboard sheet constitutes a bottom group of corrugated paperboard sheets which are stacked on the sheet feeding table through front ends and rear ends thereof in an approximately horizontal posture. When a lowermost (bottommost) corrugated paperboard sheet of the bottom group is fed toward the downstream side, a lowermost corrugated paperboard sheet of the intermediate group drops so as to be added to the bottom group of corrugated paperboard sheets, and a lowermost corrugated paperboard sheet of the top group drops so as to be added to the intermediate group of corrugated paperboard sheets.

As a result, the bottom group of corrugated paperboard sheets can be always maintained approximately constant in terms of the number of stacked corrugated paperboard sheets. This is not influenced by a sheet type and a flute type of corrugated paperboard sheet, a feeding speed of corrugated paperboard sheets, and the like. Therefore, an approximately constant pressing force is applied to a bottommost one of the entire corrugated paperboard sheets, so that it becomes possible to improve sheet feeding accuracy.

As above, a plurality of corrugated paperboard sheets stacked between the front guide and the back guide each provided to stand on the sheet feeding table are separated as a top group, wherein lower ones of the top group of corrugated paperboard sheets are obliquely moving in such a manner that front ends thereof are guided by the first separation guide surface of the first guide element, and rear ends thereof are inserted into the cutout portion of the second guide element. Then, when a front end of a lowermost corrugated paperboard sheet of the top group drops downwardly from the first separation guide surface of the first guide element, the dropped corrugated paperboard sheet is added as one of an intermediate group, wherein the rear end thereof is being guided by the second separation guide surface of the second guide element. Then, when a rear end of a lowermost corrugated paperboard sheet of the intermediate group drops from the second separation guide surface of the second guide element, the dropped corrugated paperboard sheet is added as one of a bottom group of corrugated paperboard sheets which are stacked on the sheet feeding table through front ends and rear ends thereof.

Therefore, it becomes possible to separate the top-side corrugated paperboard sheets from the bottom-side corrugated paperboard sheets so as to form a plurality of separate groups, by using the guide element having a simple structure.

In the corrugated paperboard sheet feeding apparatus, each of the corrugated paperboard sheets drops while obliquely moving under its own weight between the first guide element and the second guide element, so that no drive device is required. In addition, front and rear ends of each of the corrugated paperboard sheets are not applied with any external force pressing them in a direction causing the corrugated paperboard sheet to be reduced in length in a front-rear direction. Thus, there is no need for a drive device and a control device, and it is possible to solve a problem of occurrence of a defective corrugated paperboard sheet and a problem of deterioration in corrugated paperboard sheet feeding accuracy, due to deformation of a front or rear end of a corrugated paperboard sheet, or warpage of a corrugated paperboard sheet.

Therefore, it becomes possible to provide a corrugated paperboard sheet feeding apparatus capable of achieving separate grouping of corrugated paperboard sheets by using a simple guide element, to improve corrugated paperboard sheet feeding accuracy and suppress an increase in maintenance cost and a deterioration in operation rate thereof.

(2) Preferably, in the corrugated paperboard sheet feeding apparatus of the present invention, the cutout portion of the second guide element of the guide element has a sidewall surface formed in approximately parallel relation to the guide surface of the back guide.

In this corrugated paperboard sheet feeding apparatus, the cutout portion of the second guide element of the guide element has the sidewall surface, so that it becomes possible to define a moving space for allowing a rear end of each corrugated paperboard sheet to freely enter thereinto, between the guide surface of the back guide and the second separation guide surface. Thus, when a front end of one of the top group of corrugated paperboard sheets moves obliquely downwardly and rearwardly along the first separation guide surface, a rear end of the corrugated paperboard sheet of the top group can enter into the moving space of the cutout portion without being hindered by the guide surface of the back guide and the second separation guide surface. In this way, the rear end of the corrugated paperboard sheet of the top group reliably enters into the moving space of the cutout portion in such a manner as to be deeply inserted into the cutout portion. This makes it possible to allow a front end of a lowermost corrugated paperboard sheet of the top group to have a stable movement of slipping out of the lower edge of the first separation guide surface and dropping downwardly, to thereby form an intermediate group consisting of a given number of stacked corrugated paperboard sheets. In addition, the moving space of the cutout portion can prevent jamming of the corrugated paperboard sheet and deformation of a rear end of the corrugated paperboard sheet.

Therefore, in this corrugated paperboard sheet feeding apparatus, it becomes possible to separate the top-side corrugated paperboard sheets from the bottom-side corrugated paperboard sheets so as to form two clearly separate groups, while interposing therebetween the intermediate group consisting of a given number of stacked corrugated paperboard sheets.

(3) Preferably, in the corrugated paperboard sheet feeding apparatus of the present invention, the front guide has a sheet regulating surface located in a position opposed to the second guide element to extend downwardly from the lower edge of the first separation guide surface.

In this corrugated paperboard sheet feeding apparatus, the sheet regulating surface is formed in the front guide, so that, when a front end of a lowermost corrugated paperboard sheet of the top group slips out of the lower edge of the first separate guide surface and drops downwardly, a position of the front end in the front-rear direction can be regulated to control a dropping velocity thereof. Thus, it becomes possible to ensure a time for allowing a rear end of a new lowermost corrugated paperboard sheet of the top group located just above the dropped corrugated paperboard sheet to move into the cutout portion of the second guide member. In this way, the rear end of the new lowermost corrugated paperboard sheet of the top group is reliably inserted into the cutout portion of the second guide element, so that the intermediate group of corrugated paperboard sheets can be guided by using the entire inclination of the second separation guide surface. This makes it possible to allow a rear end of a lowermost corrugated paperboard sheet of the intermediate group to have a more stable movement of slipping out of the lower edge of the second separation guide surface and dropping downwardly.

Therefore, it becomes possible to separate the top-side corrugated paperboard sheets from the bottom-side corrugated paperboard sheets so as to form two more clearly separate groups, while interposing therebetween consisting of a given number of stacked corrugated paperboard sheets.

(4) Preferably, in the corrugated paperboard sheet feeding apparatus of the present invention, the first separation guide surface of the front guide is formed in such a manner that an inclination angle thereof with respect to a horizontal direction is greater than an inclination angle of the second separation guide surface of the back guide with respect to the horizontal direction.

In this corrugated paperboard sheet feeding apparatus, the first separation guide surface of the front guide is formed in such a manner that an inclination angle thereof with respect to a horizontal direction is greater than an inclination angle of the second separation guide surface of the back guide with respect to the horizontal direction, so that a force causing lower ones of the top group of corrugated paperboard sheets to move obliquely downwardly and rearwardly along the first separation guide surface having a relatively large inclination angle becomes greater than a force causing each of the intermediate group of corrugated paperboard sheets to move obliquely downwardly and forwardly along the second separation guide surface having a relatively small inclination angle. Thus, the lower corrugated paperboard sheets of the top group moving obliquely downwardly and rearwardly along the first separation guide surface can regulate each of the intermediate group of corrugated paperboard sheets moving obliquely downwardly and forwardly along the second separation guide surface. This makes it possible to allow a rear end of a lowermost corrugated paperboard sheet of the intermediate group to have a more stable movement of slipping out of the lower edge of the second separation guide surface and dropping downwardly, under regulation of the rear ends of the lower corrugated paperboard sheets of the top group.

Therefore, it becomes possible to separate the top-side corrugated paperboard sheets from the bottom-side corrugated paperboard sheets so as to form two more clearly separate groups, while interposing therebetween consisting of a given number of stacked corrugated paperboard sheets.

Preferably, the inclination angle of the first separation guide surface with respect to the horizontal direction is set in the range of about 65 to 75 degrees, and the inclination angle of the second separation guide surface with respect to the horizontal direction is set in the range of about 45 to 60 degrees. Preferably, the cutout portion of the second guide element is formed at a position below the lower edge of the first separation guide surface by about 50 to 100 mm.

The corrugated paperboard sheet feeding apparatus of the present invention can improve corrugated paperboard sheet feeding accuracy and suppress an increase in maintenance cost and a deterioration in operation rate thereof.

DETAILED DESCRIPTION OF THE PREFERRED EMBODIMENTS

With reference to the accompanying drawings, a corrugated paperboard sheet feeding apparatus according to one embodiment of the present invention will now be described.

<Configuration of Guide Element in Feeding Apparatus>

Figure 1:
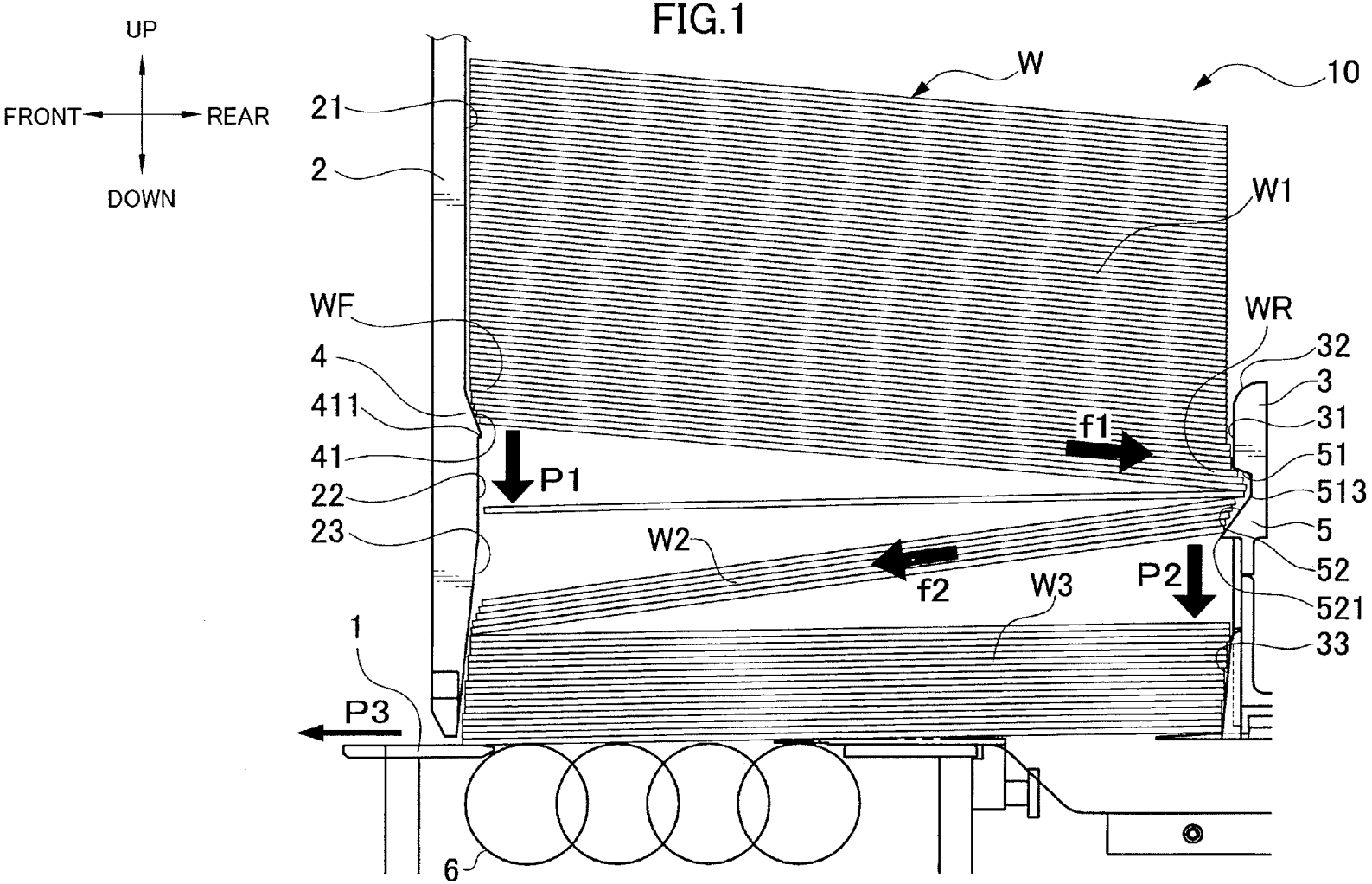
FIG. 1 is a side view of a corrugated paperboard sheet feeding apparatus according to one embodiment of the present invention.

As illustrated in FIG. 1, a corrugated paperboard sheet feeding apparatus 10 according to one embodiment of the present invention comprises a sheet feeding table 1, a front guide 2, a back guide 3, a first guide element 4, a second guide element 5 and a plurality of sheet feeding rolls 6. Two double arrowed lines illustrated in FIG. 1 indicate an up-down direction and a front-rear direction in the feeding apparatus 10, respectively.

The sheet feeding table 1 is a table configured to allow a plurality of corrugated paperboard sheets W stacked in the up-down direction to be placed thereon in a horizontal posture, wherein a sheet feeding direction (a direction indicated by the arrowed line P3) is defined as a forward direction. The front guide 2 is provided to stand vertically on the side of a front end of the sheet feeding table 1, and the back guide 3 is provided to stand vertically on the sheet feeding table 1 at a position rearward of the front guide 2. A combination of the sheet feeding table 1, the front guide 2, the back guide 3 and a non-illustrated side guide forms a hopper for allowing a plurality of corrugated paperboard sheets W to be stacked therein. The plurality of sheet feeding rolls 6 are arranged in an opening of the sheet feeding table 1 formed between the front guide 2 and back guide 3, in such a manner that a top of each outer peripheral surface thereof is disposed in approximately flush relation with an upper surface of the sheet feeding table 1. The sheet feeding rolls 6 are operable to feed out a bottommost one of the corrugated paperboard sheets, in the direction indicated by the arrowed line P3, by means of frictional contact.

Figure 2:
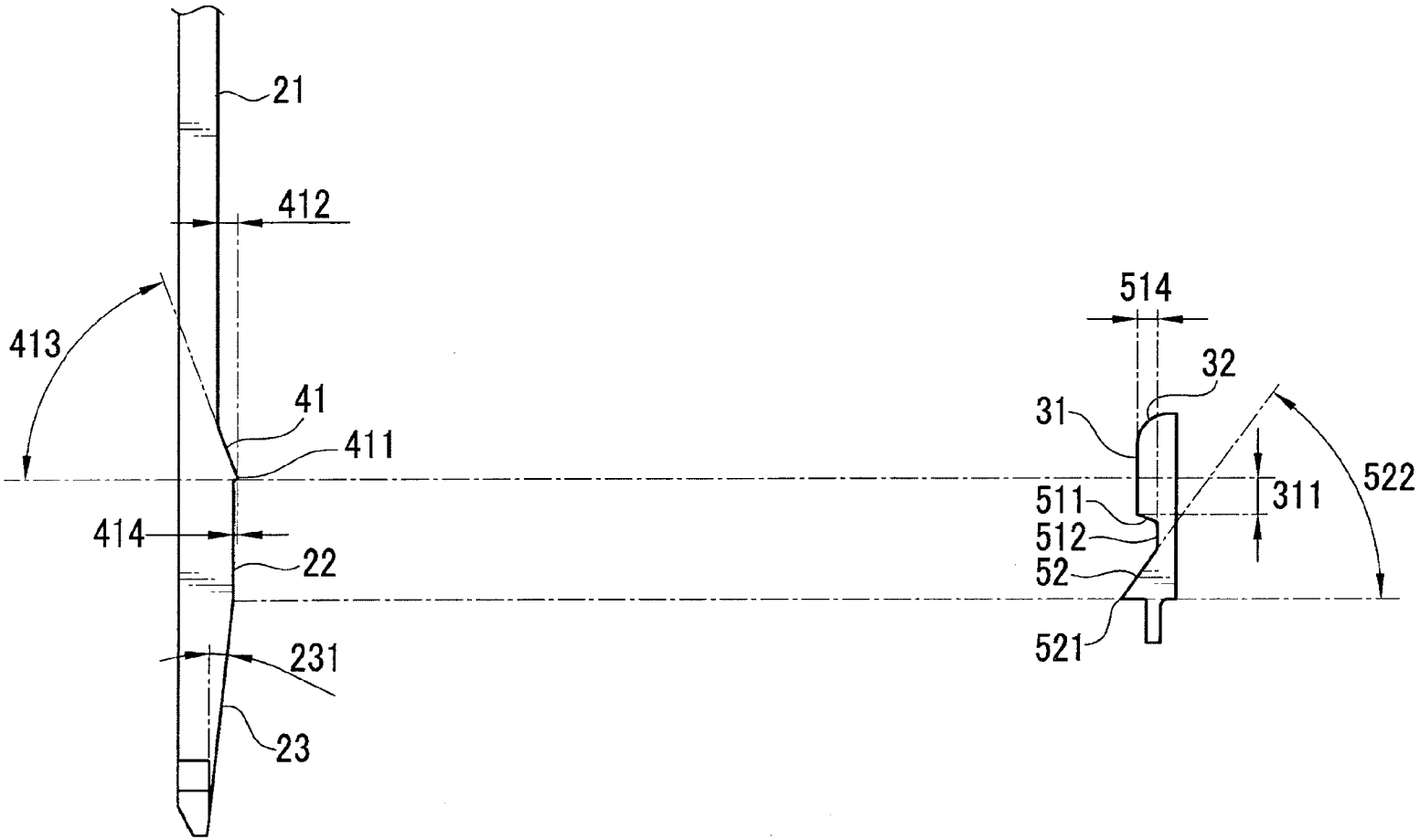
FIG. 2 is a side view of a front guide and a back guide illustrated in FIG. 1.

As illustrated in FIGS. 1 and 2, the front guide 2 is a plate-shaped member extending in the up-down direction and having a guide surface 21 for regulating a front end WF of each of the stacked corrugated paperboard sheets W. The guide surface 21 is a flat surface formed perpendicularly with respect to the sheet feeding table 1. The front guide 2 is fixed to a body frame of the feeding apparatus 10. The front guide 2 is disposed to form a gap between a lower edge thereof and the sheet feeding table 1 to allow the bottommost corrugated paperboard sheet to pass therethrough.

The first guide element 4 is provided in the front guide 2, and formed to have a first separation guide surface 41 formed to protrude obliquely downwardly and rearwardly with respect to the guide surface 21 thereof. In this embodiment, the first guide element 4 is integrally formed with the front guide 2 at a given position above the sheet feeding table 1. Alternatively, the first guide element 4 may be formed separably from the front guide 2 to allow a position thereof to be adjusted in the up-down direction. The first separation guide surface 41 is a rectangular-shaped inclined surface, wherein it is formed to have a lower edge 411 protruding with respect to the guide surface 21 of the front guide 2 by a certain distance. The first separation guide surface 41 is also formed in such a manner that an inclination angle 413 (see FIG. 2) thereof with respect to a horizontal direction is greater than an inclination angle 522 of an aftermentioned second separation guide surface 52 with respect to the horizontal direction. For example, the inclination angle 413 (see FIG. 2) of the first separation guide surface 41 with respect to a horizontal direction is preferably set in the range of about 65 to 75 degrees.

The first separation guide surface 41 has a function of causing lower ones of a plurality of corrugated paperboard sheets W stacked thereabove to move obliquely downwardly and rearwardly (in a direction indicated by the arrowed line f1), while being kept in contact with a front end WF of each of the lower corrugated paperboard sheets.

The front guide 2 has a sheet regulating surface 22 located in a position opposed to the second guide element 5 to extend downwardly from the lower edge 411 of the first separation guide surface 41. The sheet regulating surface 22 is a flat surface formed perpendicularly with respect to the sheet feeding table 1. The sheet regulating surface 22 is located rearward of the guide surface 21 of the front guide 2, and located forward of the lower edge 411 of the first separation guide surface 41. Specifically, a step 414 of about 1 to 2 mm is formed between the sheet regulating surface 22 and the lower edge 411 of the first separation guide surface 41. The sheet regulating surface 22 is formed to have a lower edge thereof located at a height position approximately equal to that of a lower edge 521 of the second guide element 5.

The sheet regulating surface 22 has a function of, when a lowermost one of a top group of corrugated paperboard sheets W1 slips out of the lower edge 411 of the first separation guide surface 41 and drops in a direction indicated by the allowed line P1, regulating a front-rear directional position of the slipped-out corrugated paperboard sheet, and controlling a dropping velocity of the slipped-out corrugated paperboard sheet. The step 414 has a function of giving initial acceleration to the slipped-out corrugated paperboard sheet.

The front guide 2 further has a first inclined guide surface 23 formed to extend obliquely downwardly and forwardly from the lower edge of the sheet regulating surface 22. The first inclined guide surface 23 formed to extend up to the lower edge of the front guide 2.

The first inclined guide surface 23 has a function of, when an aftermentioned second inclined guide surface 33 causes lower ones of a bottom group of corrugated paperboard sheets W3 stacked on the sheet feeding table 1 to gradually move forwardly, guiding a front end WF of each of the lower corrugated paperboard sheets of the bottom group W3.

Figure 3:
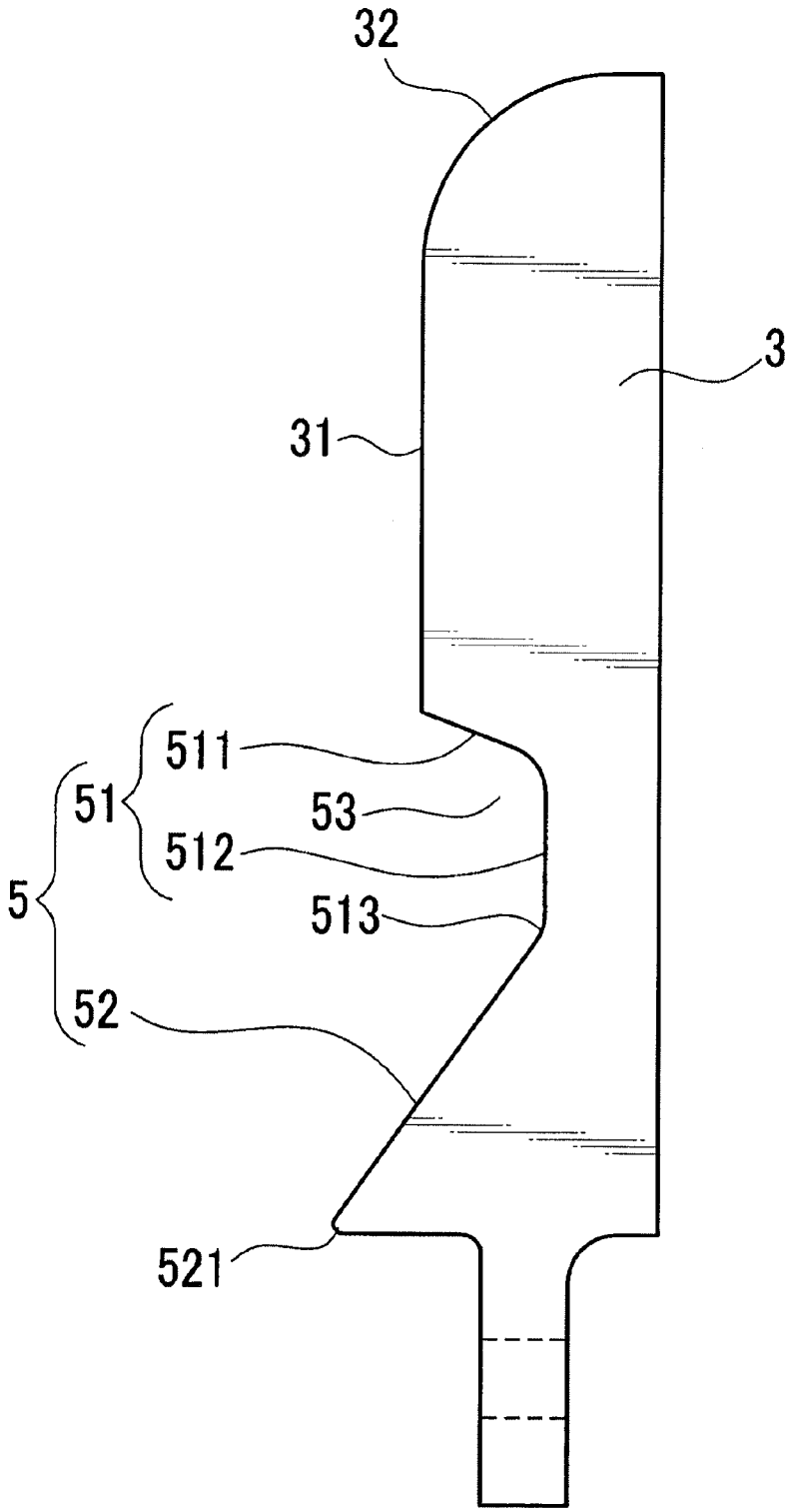
FIG. 3 is a detailed side view of a back guide illustrated in FIG. 1.

As illustrated in FIGS. 1, 2 and 3, the back guide 3 is a plate-shaped member extending in the up-down direction and having a guide surface 31 for regulating a rear end WR of each of the stacked corrugated paperboard sheets W. The guide surface 31 is a flat surface formed perpendicularly with respect to the sheet feeding table 1. The back guide 3 is supported by the body frame of the feeding apparatus 10, in such a manner as to allow a position thereof to be adjusted in the front-rear direction. The front-rear directional position of the back guide 3 is adjusted in conformity to a length (front-rear directional dimension) of corrugated paperboard sheets W to be stacked. The back guide 3 is divided into two upper and lower portions to allow an up-down directional height thereof to be changed. The back guide 3 is formed to have an upper end located at a height position lower than an upper end of the front guide 2. The upper end of the back guide 3 is formed with an upwardly convexedly curved surface 32. The lower portion of the back guide 3 has a second inclined guide surface 33 formed to extend obliquely downwardly and forwardly.

The upwardly convexedly curved surface 32 has a function of correcting a front-rear directional displacement in the top group of corrugated paperboard sheets W1 during stacking to thereby uniform positions of the top group of corrugated paperboard sheets W1 in the up-down directions. The second inclined guide surface 33 has a function of causing lower ones of the bottom group of corrugated paperboard sheets W3 stacked on the sheet feeding table 1 to gradually move forwardly, in cooperation with the aforementioned first inclined guide surface 23.

The second guide element 5 is provided in the back guide 3, and formed to have a cutout portion 51 located below the lower edge 411 of the first separation guide surface 41 and concaved rearwardly from the guide surface 31 of the back guide 3, and a second separation guide surface 52 extending obliquely downwardly and forwardly from a lower edge 513 of the cutout portion 51 and protruding forwardly with respect to the guide surface 31 of the back guide 3. An up-down directional distance 311 between the lower edge 411 of the first separation guide surface 41 and an upper edge of the cutout portion 51 is preferably set in the range of about 50 to 100 mm.

The cutout portion 51 of the second guide element 5 has an upper wall surface 511 formed to extend rearwardly from the guide surface 31 of the back guide 3, and a sidewall surface 512 formed in approximately parallel relation to the guide surface 31 of the back guide 3. A combination of the upper wall surface 511 and the sidewall surface 512 forms an approximately L-shaped concave surface to thereby define a moving space 53 for allowing a rear end WR of each of the lower corrugated paperboard sheets of the top group W1 to freely enter thereinto. The cutout portion 51 is formed in such a manner that an amount of concavity 514 thereof with respect to the guide surface 31 of the back guide 3 is greater than an amount of protrusion 412 of the lower edge 411 of the first separation guide surface 41 with respect to the guide surface 21 of the front guide 2. For example, the amount of concavity 514 is preferably set to be about two to four times greater than the amount of protrusion 412.

The cutout portion 51 has a function of allowing a rear end WR of a lowermost corrugated paperboard sheet of the top group W1 moving obliquely downwardly and rearwardly along the first separation guide surface 41 to be inserted thereinto to thereby cause a front end WF of the lowermost corrugated paperboard sheet of the top group W1 to slip off of the lower edge 411 of the first separation guide surface 41 and drop downwardly.

The second separation guide surface 52 of the second guide element 5 is a rectangular-shaped inclined surface which is formed to have a lower edge 521 protruding with respect to the guide surface 31 of the back guide 3 by a certain distance. The second separation guide surface 52 is formed in such a manner that an inclination angle 522 thereof with respect to the horizontal direction is smaller than the inclination angle 413 of the aforementioned first separation guide surface 41 with respect to the horizontal direction. For example, the inclination angle 522 is preferably set in the range of about 45 to 60 degrees.

The second separation guide surface 52 has a function of causing each of an intermediate group of corrugated paperboard sheets W2 to move obliquely downwardly and forwardly (in a direction indicated by the arrowed line f2), while being kept in contact with a rear end WR of each of the intermediate group of corrugated paperboard sheets W2.

<Operation of Feeding Apparatus>

Figure 4:
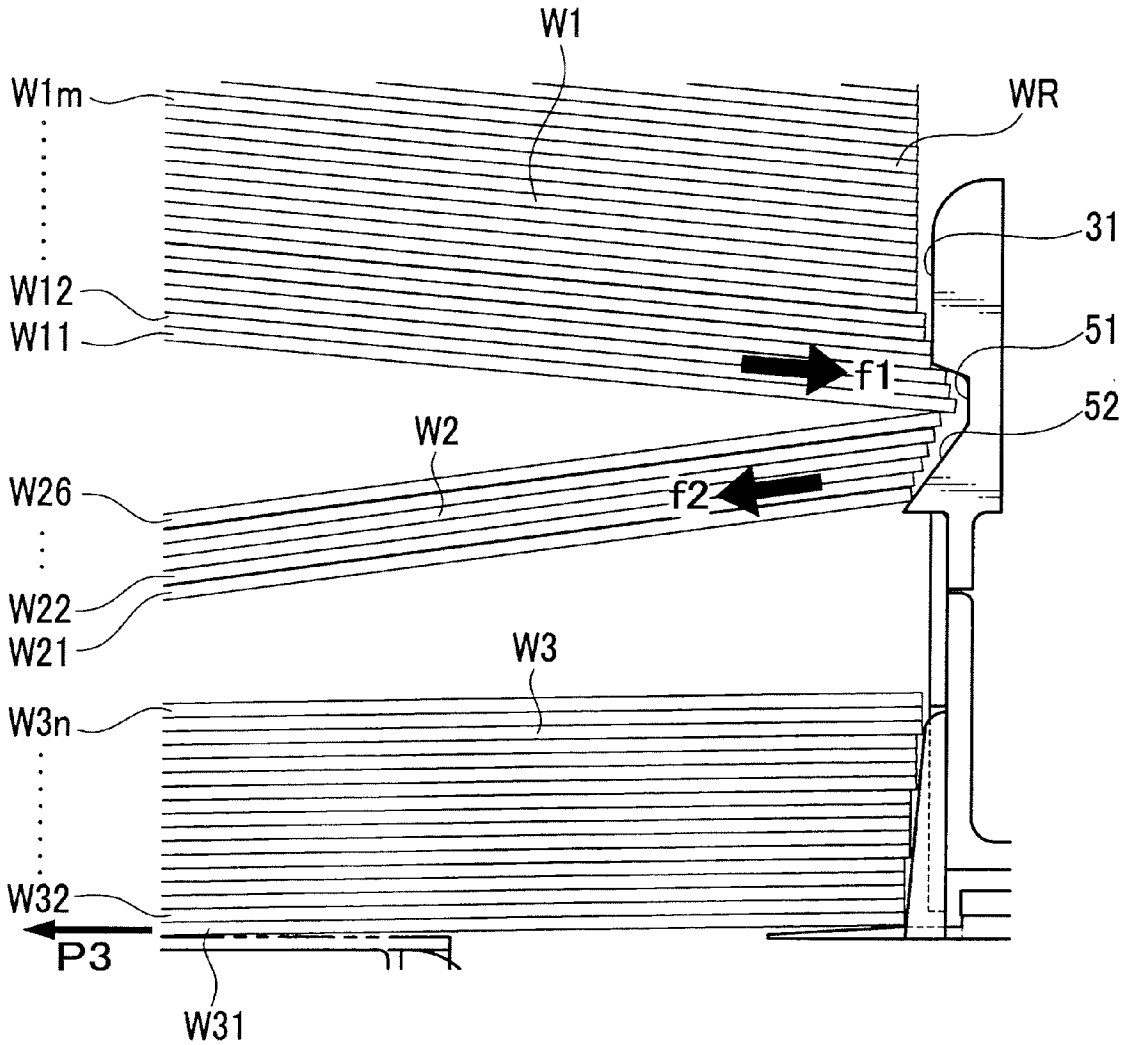
FIG. 4 is an explanatory diagram of an operation of the corrugated paperboard sheet feeding apparatus illustrated in FIG. 1.
Figure 5:
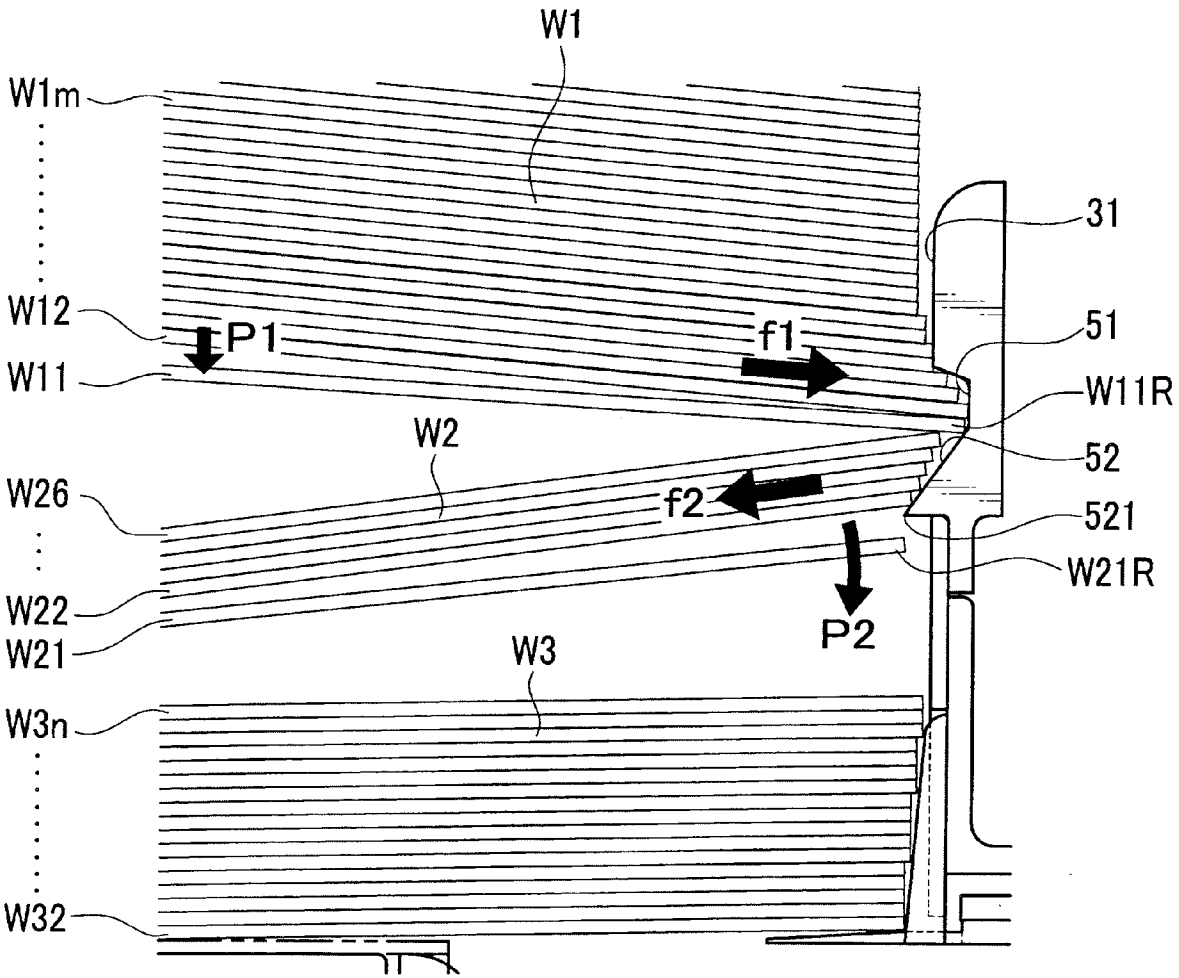
FIG. 5 is an explanatory diagram of the operation of the corrugated paperboard sheet feeding apparatus illustrated in FIG. 1.

With reference to FIGS. 1, 4 and 5, an operation of separating top-side ones of a plurality of corrugated paperboard sheets from bottom-side ones of the corrugated paperboard sheets so as to form a plurality of separate groups by using the first guide element and the second guide element in the corrugated paperboard sheet feeding apparatus according to this embodiment will be described below.

As illustrated in FIG. 1, when a plurality of corrugated paperboard sheets W are input between the front guide 2 and the back guide 3 each provided to stand on the sheet feeding table 1, the corrugated paperboard sheets W are stacked while being separated into three groups: a top group of corrugated paperboard sheets W1; an intermediate group of corrugated paperboard sheets W2; and a bottom group of corrugated paperboard sheets W3.

A sheet feeding operation of the feeding apparatus 10 is started by rotating the sheet feeding rolls 6 to feed out a bottommost corrugated paperboard sheet of the bottom group W3 in the direction indicated by the arrowed line P3. In this sheet feeding operation, the top group of corrugated paperboard sheets W1, the intermediate group of corrugated paperboard sheets W2 and the bottom group of corrugated paperboard sheets W3 make the following movements.

As illustrated in FIGS. 1, 4 and 5, when a bottommost corrugated paperboard sheet W31 of the bottom group W3 (W31 to W3*n*) is fed out in the direction indicated by the arrowed line P3, a rear end WR of each of the intermediate group of corrugated paperboard sheets W2 (W21 to W26) moves obliquely downwardly and forwardly (in the direction indicated by the arrowed line f2) along the second separation guide surface 52. When a rear end W21R of a lowermost corrugated paperboard sheets W21 of the intermediate group W2 (W21 to W26) moves obliquely along the second separation guide surface 52 to reach the lower edge 521, the rear end W21R slips out of the lower edge 521 and drops downwardly (in a direction indicated by the allowed line P2). The dropped corrugated paperboard sheet W21 is added to the bottom group of corrugated paperboard sheets W3 (W31 to W3*n*) which are stacked on the sheet feeding table through front ends WF and rear ends WR thereof in an approximately horizontal posture.

When the rear end W21R of the lowermost corrugated paperboard sheet W21 of the intermediate group slips out of the lower edge 521 and drops downwardly (in the direction indicated by the allowed line P2), a front end WF of one of the top group of corrugated paperboard sheets W1 newly comes into contact with the first separation guide surface 41 of the first guide element 4, and each of the lower corrugated paperboard sheets (W11, W12, etc.) of the top group W1 being in contact with the first separation guide surface 41 moves obliquely downwardly and rearwardly (in the direction indicated by the arrowed line f1) along the first separation guide surface 41.

Concurrently, a rear end WR of each of the lower corrugated paperboard sheets (W11, W12, etc.) of the top group W1 moving obliquely downwardly and rearwardly (in the direction indicated by the arrowed line f1) along the first separation guide surface 41 is inserted into the cutout portion 51 of the second guide element 5. Then, the amount of concavity 514 (see FIG. 2) of the cutout portion 51 with respect to the guide surface 31 of the back guide 3 is greater than the amount of protrusion 412 (see FIG. 2) of the first separation guide surface 41 with respect to the guide surface 21 of the front guide 2. Thus, when a rear end W11R of a lowermost corrugated paperboard sheet W11 of the top group W1 (W11 to W1*m*) is inserted into the cutout portion 51, a front end WF of the lowermost corrugated paperboard sheet of the top group W1 slips out of the lower edge 411 of the first separation guide surface 41 and drops downwardly (in a direction indicated by the allowed line P1) to become one of the intermediate group of corrugated paperboard sheets W2.

Therefore, when a bottommost corrugated paperboard sheet W31 of the bottom group W3 (W31 to W3*n*) is fed out in the direction indicated by the arrowed line P3, each of a lowermost corrugated paperboard sheet of the top group W1 and a lowermost corrugated paperboard sheet of the intermediate group W2 drops so as to add one corrugated paperboard sheet to the bottom group of corrugated paperboard sheets W3, so that the bottom group of corrugated paperboard sheets W3 can be always maintained approximately constant in terms of the number of stacked corrugated paperboard sheets. Thus, it becomes possible to always apply an approximately constant frictional force to the bottommost corrugated paperboard sheet when the sheet feeding rolls 6 are rotated, thereby improving accuracy of sheet feeding using the sheet feeding rolls 6. This is not influenced by a sheet type and a flute type of corrugated paperboard sheet, a feeding speed of corrugated paperboard sheets, and the like.

As above, a plurality of corrugated paperboard sheets W stacked between the front guide 2 and the back guide 3 each provided to stand on the sheet feeding table 1 are separated as a top group W1, wherein lower ones of the top group W1 of corrugated paperboard sheets are obliquely moving in such a manner that front ends WF thereof are guided by the first separation guide surface 41 of the first guide element 4, and rear ends WR thereof are inserted into the cutout portion 51 of the second guide element 51. Then, when a rear end WR of a lowermost corrugated paperboard sheet of the top group W1 drops downwardly from the first separation guide surface 41 of the first guide element 4, the dropped corrugated paperboard sheet is added as one of an intermediate group W2, wherein the rear end thereof is being guided by the second separation guide surface 52 of the second guide element 5. Then, when a rear end WR of a lowermost corrugated paperboard sheet of the intermediate group W2 drops from the second separation guide surface 52 of the second guide element 5, the dropped corrugated paperboard sheet is added as one of a bottom group of corrugated paperboard sheets W3 which are stacked on the sheet feeding table 1 through front ends WF and rear ends WR thereof.

Therefore, a plurality of corrugated paperboard sheets W stacked between the front guide 2 and the back guide 3 each provided to stand on the sheet feeding table 1 can be fed while separating top-side ones of the corrugated paperboard sheets from bottom-side ones of the corrugated paperboard sheets so as to form a plurality of separate groups.

<Modifications>

The above embodiment may be modified without departing from the spirit and scope of the present invention as set forth in appended claims.

(1) In the above embodiment, the cutout portion 51 of the second guide element 5 has the upper wall surface 511 formed to extend rearwardly from the guide surface 31 of the back guide 3, and the sidewall surface 512 formed in approximately parallel relation to the guide surface 31 of the back guide 3. However, the present invention is not limited thereto.

Figure 6:
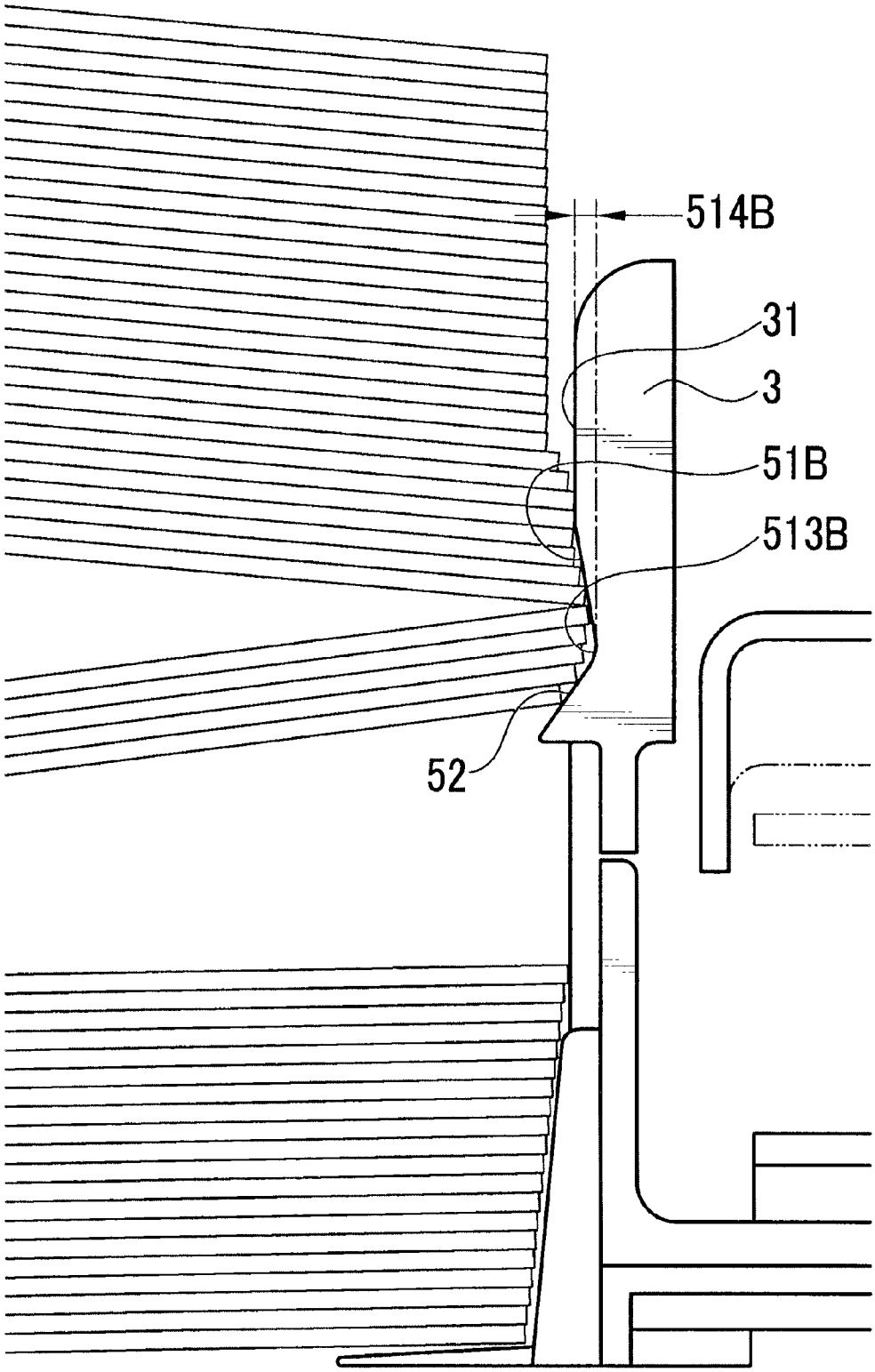
FIG. 6 is a side sectional view of a modification of the back guide illustrated in FIG. 1.
Figure 7:
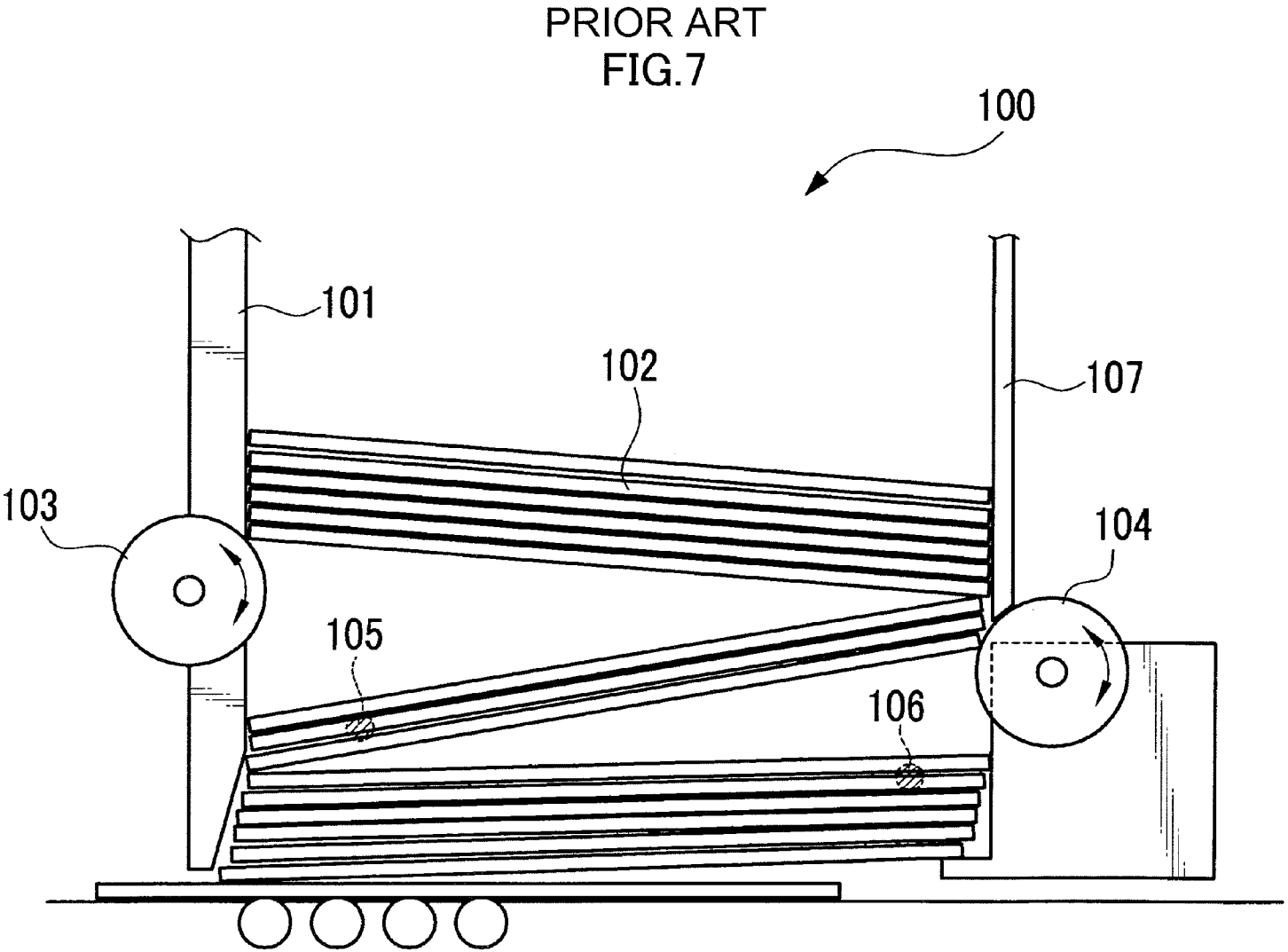
PRIOR ART FIG.7
FIG. 7 is a side sectional view of a conventional corrugated paperboard sheet feeding apparatus.

For example, as illustrated in FIG. 6, a cutout portion 51B may be formed to have an inclined surface extending obliquely downwardly and rearwardly from the guide surface 31 of the back guide 3, wherein the second separation guide surface 52 may be formed to extend obliquely downwardly and forwardly from a lower edge 513B of the inclined surface. Further, the inclined surface is not limited to a liner flat surface, but may be a curved surface concaved rearwardly. In this case, it is also necessary to form the cutout portion 51B in such a manner that an amount of concavity 514B thereof with respect to the guide surface 31 of the back guide 3 is greater than the amount of protrusion 412 of the lower edge 411 of the first separation guide surface 41.

(2) In the above embodiment, the sheet regulating surface 22 of the front guide 2 is a flat surface formed perpendicularly with respect to the sheet feeding table 1, wherein it is located rearward of the guide surface 21 of the front guide 2, and located forward of the lower edge 411 of the first separation guide surface 41. Specifically, the step 414 of about 1 to 2 mm is formed between the sheet regulating surface 22 and the lower edge 411 of the first separation guide surface 41. However, the present invention is not limited thereto.

For example, the sheet regulating surface 22 may be formed as a flat surface extending downwardly from the lower edge 411 of the first separation guide surface 41 without going through the step 414. Further, instead of a flat surface, the sheet regulating surface 22 may be formed as an arc-shaped curved surface concaved forwardly.

What is claimed is:

1. A corrugated paperboard sheet feeding apparatus for sequentially feeding a plurality of stacked corrugated paperboard sheets toward a downstream side, comprising:

a sheet feeding table;

a front guide provided to stand on the sheet feeding table, the front guide having a front guide surface facing rearwardly for regulating vertical travel of a front end of each corrugated paperboard sheet;

a back guide provided to stand on the sheet feeding table, the back guide having a back guide surface facing forwardly opposite to the front guide surface of the front guide for regulating vertical travel of a rear end of the corrugated paperboard sheet; and guide elements configured to come into contact with front and rear ends of each of the plurality of corrugated paperboard sheets stacked vertically between the front guide and the back guide and to separate top-side ones of the corrugated paperboard sheets from bottom-side ones of the corrugated paperboard sheets so as to form a plurality of vertically arranged, separate stacks of corrugated paperboard sheets, wherein the guide elements include:

a first guide element formed in the front guide and having a first oblique separation guide surface sloped downwardly and rearwardly, and continuously from a lower end of the front guide surface of the front guide; and a second guide element formed in the back guide and having a cutout portion concaved rearwardly and continuously from a lower end of the back guide surface of the back guide, an upper end of the cutout portion being situated vertically lower than a lower end of the first oblique separation guide surface, the second guide element further having a second oblique separation guide surface sloped continuously from a lower end of the cutout portion and downwardly and forwardly to a lower end thereof situated further forwardly than the back guide surface of the back guide, and further wherein the cutout portion of the second guide element is formed in such a manner that a depth thereof measured from the back guide surface of the back guide is greater than a height of a lower end of the first oblique separation guide surface of the first guide element measured from the front guide surface of the front guide.

2. The corrugated paperboard sheet feeding apparatus as defined in claim 1, wherein the cutout portion of the second guide element has a sidewall surface at its bottom extensive approximately in parallel to the back guide surface of the back guide.

3. The corrugated paperboard sheet feeding apparatus as defined in claim 1, wherein the front guide has a sheet regulating surface located opposite to the second guide element and extending downwardly from a lower end of the first oblique separation guide surface.

4. The corrugated paperboard sheet feeding apparatus as defined in claim 1, wherein the first oblique separation guide surface of the front guide is formed in such a manner that an inclination angle thereof with respect to a horizontal direction is greater than an inclination angle of the second oblique separation guide surface of the back guide with respect to the horizontal direction.

* * * * *